United States Patent [19]

Grosshauser et al.

[11] Patent Number: 4,958,561

[45] Date of Patent: Sep. 25, 1990

[54] INKING BAR FOR FLUSH INKING UNIT

[75] Inventors: Heinrich K. Grosshauser; Willi A. P. Kutzner; Georg Schneider, all of Wurzburg, Fed. Rep. of Germany

[73] Assignee: Koenig & Bauer Aktiengesellschaft, Würzburg, Fed. Rep. of Germany

[21] Appl. No.: 265,568

[22] Filed: Nov. 1, 1988

[30] Foreign Application Priority Data

Nov. 5, 1987 [DE] Fed. Rep. of Germany ..... 3737531

[51] Int. Cl.[5] ..... B41F 31/04; B41F 31/06; B41L 27/08

[52] U.S. Cl. ..... 101/363; 101/366

[58] Field of Search ..... 101/363, 350, 366, 148, 101/207-210, 365; 118/410, 412, 413, 411, 414, 212, 259, 261, 262

[56] References Cited

U.S. PATENT DOCUMENTS

| | | | |
|---|---|---|---|
| 1,778,600 | 10/1930 | Jones . | |
| 3,044,396 | 7/1962 | Aller | 101/157 |
| 3,533,833 | 10/1970 | Takahashi et al. | 118/410 X |
| 4,158,333 | 6/1979 | Navi . | |
| 4,559,871 | 12/1985 | Kutzner et al. | 101/366 X |
| 4,643,127 | 2/1987 | Wanke | 118/413 |
| 4,688,516 | 8/1987 | Sommer | 118/410 |
| 4,834,018 | 5/1989 | Solinger et al. | 427/356 |

FOREIGN PATENT DOCUMENTS

| | | | |
|---|---|---|---|
| 1140587 | 12/1962 | Fed. Rep. of Germany . | |
| 95770 | 2/1973 | Fed. Rep. of Germany | 118/410 |
| 3135711A1 | 2/1983 | Fed. Rep. of Germany . | |
| 3446757 | 5/1986 | Fed. Rep. of Germany | 118/413 |
| 3616645 | 11/1987 | Fed. Rep. of Germany | 118/410 |
| 2121024 | 7/1972 | France . | |

OTHER PUBLICATIONS

"The Characteristics of Flow in a Short-Dwell Coater", Dan E. Eklund & Philip C. Norrdaht, Tappi Journal, May, 1986.

*Primary Examiner*—J. Reed Fisher

*Attorney, Agent, or Firm*—Jones, Tullar & Cooper

[57] ABSTRACT

An inking bar for a flush inking unit in a rotary printing press utilizes a profiled body which is situated in an ink distributing chamber in the inking bar to minimize turbulence in the ink. This profiled body is pivotably or rotatably carried in the ink distributing chamber so that the pressure between its surface and a cooperating surface of the screened surface ink fountain roller can be varied.

7 Claims, 5 Drawing Sheets

INKING BAR FOR FLUSH INKING UNIT

FIELD OF THE INVENTION

The present invention is directed to an inking bar for a flush inking unit. More particularly, the pre®ent invention is directed to an inking bar for a flush inking unit of a rotary printing press. Most specifically, the present invention is directed to an inking bar for a flush inking unit in which a profiled body is arranged in the ink distribution chamber of the inking bar. In a first preferred embodiment, the profiled body is pivotally mounted in the ink distribution chamber while in a second preferred embodiment, the profiled body is rotatably supported n the ink distribution chamber.

DESCRIPTION OF THE PRIOR ART

Flush inking units for use with rotary printing presses are generally known in the art These inking units typically utilize an ink holding or distribution chamber and one or more doctor or scraper blades to supply ink to the surface of an ink fountain roller. In German published unexamined patent application No 31 35 711 there is shown a flush inking unit for a rotary printing press. The flush inking unit consists of an inking bar and spaced overshot and undershot doctor blades which, together with a screen type ink fountain roller, create an ink distributing groove. This ink distributing groove has a rectangular cross-section area and an additional edge in the doctor blade area. These corners and edges tend to create turbulence and vibrations within the ink which, particularly at high circumferential speeds of the screen type ink fountain roller, are apt to cause ink bubbles and thus lead to a nonuniform inking of the screen type ink fountain roller and to imperfect filling of the indentations on the screen roller surface.

In U.S. Pat. No. 4,158,888 there is shown a flush inking unit which is placed against a screened surface type of ink fountain roller. This flush inking unit has an undershot doctor blade and uses a series of generally vertically oriented baffles with openings in an effort to diminish high rotational speed induced vibrations and turbulence in the ink. This flush inking unit is usable only in one direction of rotation of the screen type ink surface roller. In addition, the ink supply through stationary baffles and openings does not contribute to a pressure modification of the ink on the screen type ink fountain roller. Furthermore, this flush inking unit has an extremely large space requirement which is many times larger than that of a traditional inking bar. Thus the inking unit disclosed in this prior patent is not completely satisfactory.

It will thus be seen that a need exists for an inking unit for use with a rotary screen surface ink fountain roller which will effectively eliminate non-uniformities in the ink coating supplied to the roller. The inking bar for a flush inking unit, in accordance with the present invention provides such a device and is a significant advance in the art.

SUMMARY OF THE INVENTION

It is an object of the present invention to provide a flush inking unit for a rotary printing press.

Another object of the present invention is to provide a flush inking unit having an inking bar.

A further object of the present invention s to provide a flush inking unit which improves the flow of ink in the ink chamber.

Yet another object of the present invention is to provide a flush inking unit having a profiled body situated in the inking bar.

Still a further object of the present invention is to provide a flush inking unit having a movable profiled body in the inking bar.

Even yet another object of the present invention is to provide a movable profiled body which is pivotable in the ink distribution chamber.

As will be discussed in greater detail in the description of the preferred embodiments, which are set forth subsequently, the flush inking unit in accordance with the present invention has an ink distributing chamber in an inking bar that, in combination with an upper doctor blade and a lower stripping blade supplied ink to the surface of the screened surface ink fountain roller A profiled body is positioned within the ink distributing chamber and is used to improve the flow of ink to the surface of the screened ink fountain roller. In one preferred embodiment this profiled body is pivotably supported in the ink distributing chamber. This profiled bar can be pivoted about an elongated axis to vary the spacing between a surface of the profiled bar and the screened surface ink fountain roller. In the second preferred embodiment, the profiled body is generally roller shaped nd is rotatably supported in the ink distributing chamber in such a manner that it may be brought into contact with the surface of the screened ink fountain roller.

The inking bar for a flush inking unit in accordance with the present invention creates a uniform flow of ink, without bubbles or turbulence, for application to the surface of the ink fountain roller. This allows the screened surface of this roller to be uniformly and completely coated with ink. Even when the ink fountain roller is operating at high rotational speeds, the inking bar of the present invention provides a more complete filling of the indentations of the ink roller. The profile shape of the profiled body in the inking bar in the first embodiment provides an adjustable space between the surface of the profiled body and the screened surface ink roller. This space aids in the more effective placement of the ink onto the screen roller. In the second preferred embodiment, the profiled body is generally roller shaped and may either contact or be slightly spaced from the surface of the screen roller.

The inking bar for the inking fountain in accordance with the present invention does not require complex baffles and can be used equally well in either direction of rotation of the screen roller. The resulting ink coating is free of bubbles and is much more uniformly applied to the screened surface ink fountain roller than Was possible with prior art device. Thus the inking unit in accordance with the present invention represents a significant advance.

BRIEF DESCRIPTION OF THE DRAWINGS

While the novel features of the inking bar for a flush inking unit in accordance with the present invention are set forth with particularity in the appended claims, a full and complete understanding of the invention may be had by referring to the detailed description of the preferred embodiments as are presented subsequently, and as illustrated in the accompanying drawings in which:

DESCRIPTION OF THE PREFERRED EMBODIMENT

Figure 1:
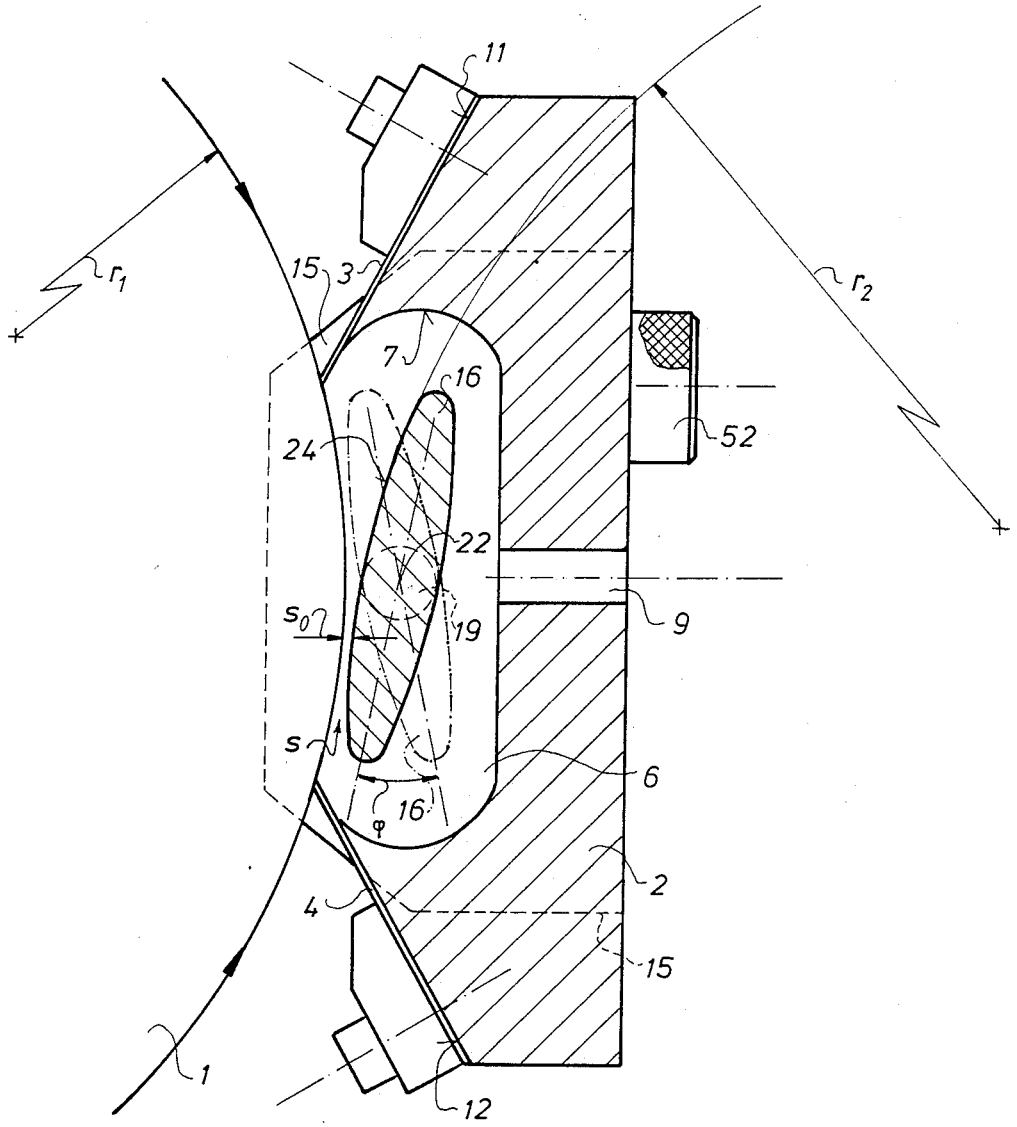
FIG. 1 is a side elevation view, partly in cross-section of a first preferred embodiment of an inking bar in accordance with the present invention.

Referring initially to FIG. 1, there may be seen a screen type ink fountain roller 1 which is being utilized as an inking up roller nd Which is rotatably located in inking unit blocks (not shown). The screen type ink fountain roller 1 cooperates with an inking bar 2 that is arranged parallel to an axis of rotation of fountain roller I and which is provided with an upper doctor blade 3 and a lower stripping blade 4 to form an ink distributing chamber 6 having a length generally the same as fountain roller 1. The ink distributing chamber 6 has smooth, rounded off interior surfaces 7. In the center of the ink distributing chamber 6 there is provided a borehole 9 for the supply of ink to chamber 6. This can be connected to an ink supply device not shown. The upper doctor blade 3 may be screwed from the outside to an upper slant portion 11 of the inking bar 2, while the lower stripping blade 4 may be screw from the outside to a lower slant 12 of the inking bar 2. A may be seen in FIG. 1, and more clearly in FIG. 3, side plates 14 and 15 are secured to end faces of the inking bar 2. These side plates 14 nd 15 extend beyond the inking bar 2 and partially cover end surfaces 8 and 18, respectively of the screened surface ink fountain roller 1.

Figure 3:
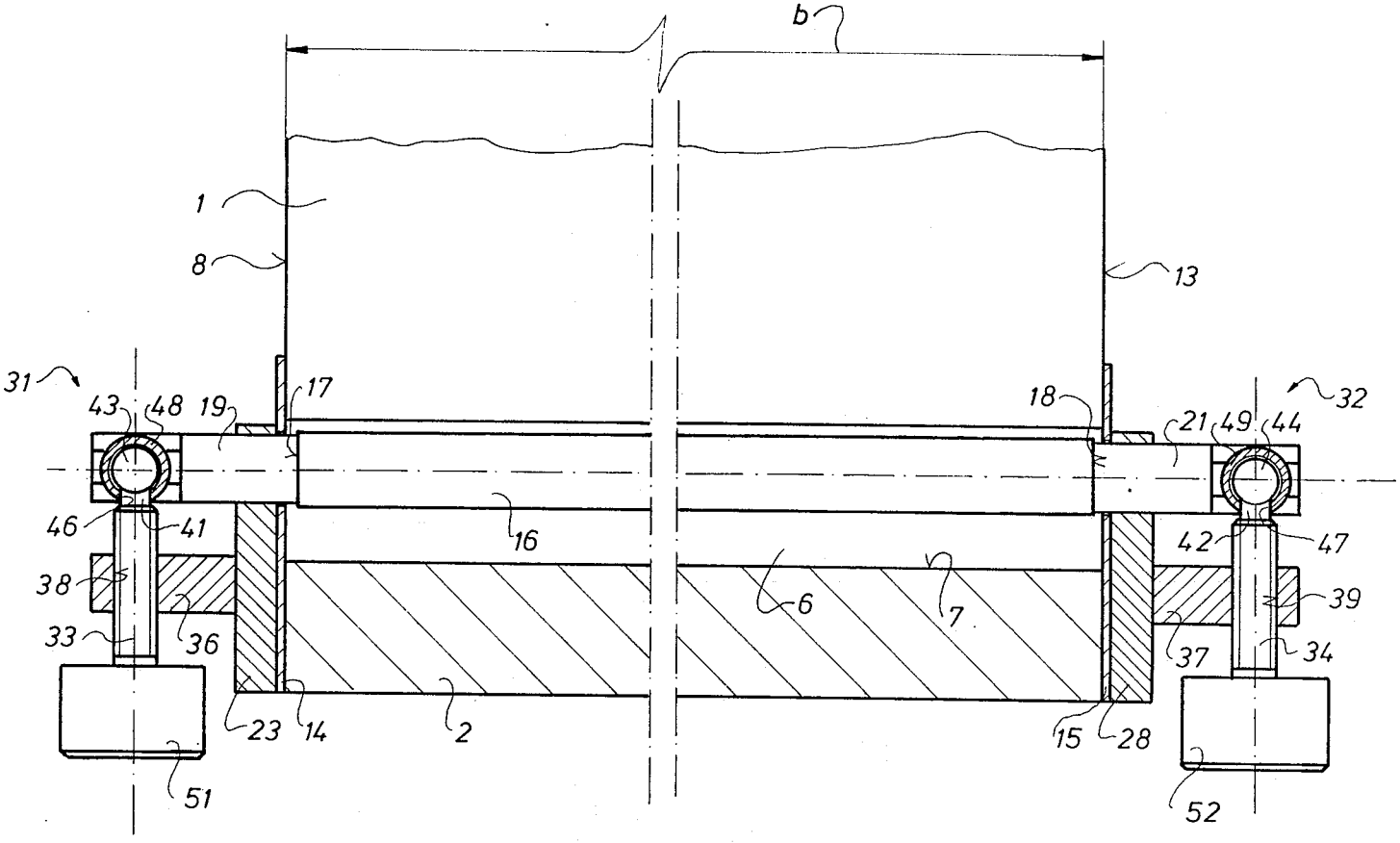
FIG. 3 is a top plan view, partly in cross-section and taken along line III—III of FIG. 2.

Referring again primarily to FIG. 1, a profiled body 16 is rotatably supported in ink distributing chamber 6. Profiled body 16 has axially extending journals 19 and 21 at its ends 17 and 18. The journal 19 and 21 are rotatably supported in chequer plates 23 and 28 which are secured to the ends of the inking bar 2, as may b seen most clearly in FIG. 3. These chequer plates 2B and 28 are placed exteriorly of the end plates 14 and 15 which form the ends of the ink distributing chamber 6. This profiled body 16 is generally elliptical in cross-sectional shape, as seen in FIG. 1, and is spaced in ink distribution chamber 6 such that ink can freely flow around profiled body 16. The elliptical shaped portion of profiled body 16 has an axial length which is only slightly less than the width b of the screened surface ink fountain roller 1, as is shown in FIG. 3. The axis of rotation 22 of profiled body 16 is generally parallel to an axis of rotation of ink fountain roller 1.

Rotation of the profiled body 16 about its axis of rotation 22 modifies the gap width $S_O$ as seen in FIG. I. The gap S is defined by the screen type ink fountain roller i and the peripheral surface 24 of the profiled body 16 which is turned to the screen type ink fountain roller. A force F of the ink in gap S is, seen in the sense of rotation of the screen type ink fountain roller I, the largest in front of the smallest gap width $S_O$. The carrying capacity F/b of the ink and thus the force of the ink on the indentations 28 of the screen type ink fountain roller can be calculated according to the following formula:

$$F = 1.225 \times b \times \eta \times (V_1 + V_2) \frac{2\, r_1 \times r_2}{r_1 + r_2} \times \frac{1}{S_O}$$

wherein $\eta$ = tackiness of the ink $r_1$ = radius of the screened ink fountain roller 1

$r_2$ = radius of the peripheral surface 24 of the profiled bodY 16

$V_1$ = circumferential speed of the screened ink fountain roller $V_2$ = circumferential speed of the profiled body 16 b = length of the profiled body 16.

In this instance since $V_2$, the circumferential speed of the profiled body 16 is 0 because the profiled body 16 is stationary, it will be seen that a change in the width of the smallest gap, $S_O$ directly modifies the force of the ink on the screened surface ink fountain roller.

Figure 2:
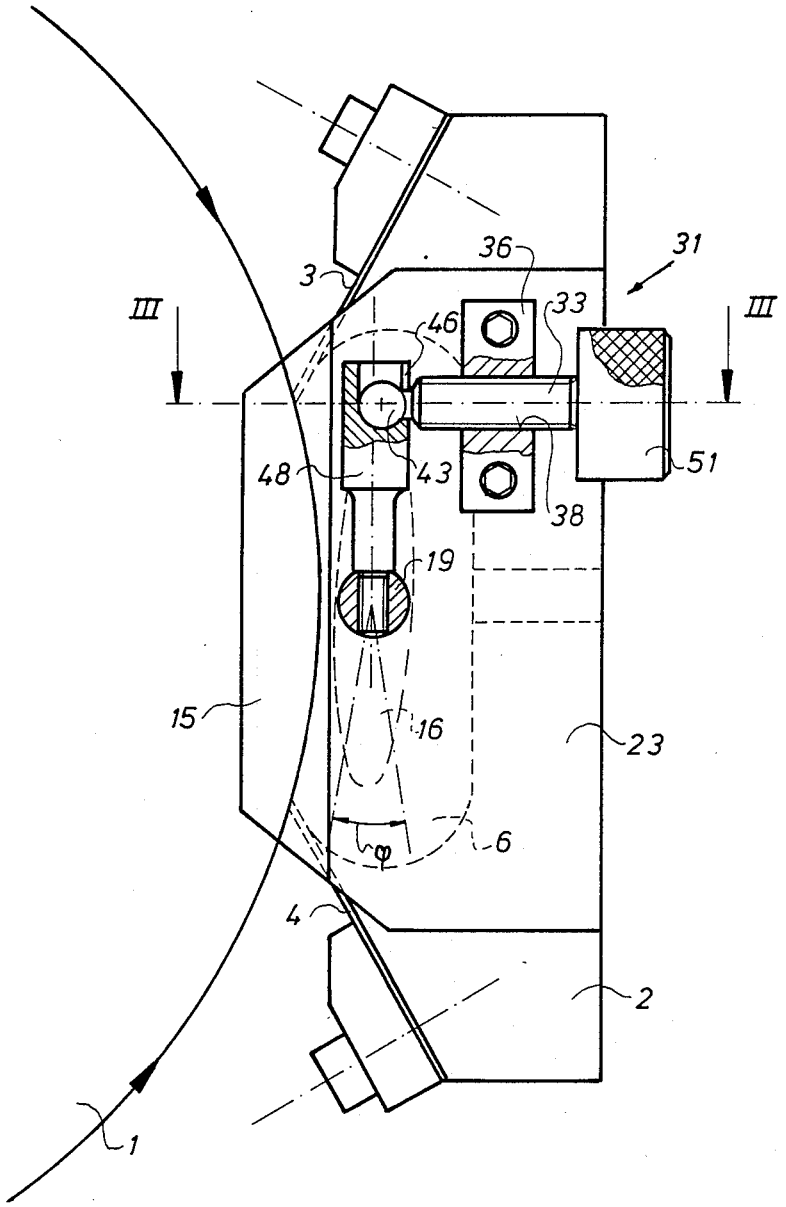
FIG. 2 is a side elevation view, partly in cross-section and showing the profiled body adjusting device of the first embodiment of the present invention.

The profiled body 16 is pivoted by means of adjusting devices 31 and 32 which are positioned outside the chequer plates 28 and 28, respectively. The adjusting devices 81 and 32 each consist of an adjusting spindle S3 or 34 which i screwed through a threaded hole 38 or 39 in a holder 86 or 37 that is secured on the chequer plate 23 or 28 as seen in FIG. 2. At a first end 41 or 42 the adjusting spindle 33 or 34 has a ball 48 or 44 which is fitted n a vertical guide slot 46 or 47 of a lever 48 or 49. This lever 48 or 49 i arranged on the journal 19 or 21 which passes through the side plate 14 or 15, and the chequer plate 23 or 28 for rotation of the journal. Each adjusting spindle 33 or 34 possesses an adjusting knob 51 or 52 which may be knurled for easy manual operation. It Would also b possible to arrange a servo motor for a possible remote control of the profiled body 16. In this instance the servo motor could effect rotation of the adjusting spindles 33 and 34. Other similar power operated adjusting means could also be utilized.

As may be seen in FIGS. 1 and 2, the adjusting devices 31 and 32 can be used to move the profiled body 16 out of the central position shown in dashed lines in FIG. 2 to one of the positions depicted in FIG. 1, through an angle $\phi$ of generally bout 20°. The solid line position of profiled body 16 shown in FIG. 1 is appropriate for a clockwise direction of rotation of screened ink fountain roller 1 while the position of the profiled body 16 depicted in dashed lines would be suitable for use with an opposite, or counterclockwise direction of rotation of ink fountain roller 1. It will also be understood that, as discussed above, the force F of the screened surface ink fountain roller is a function of the spacing $S_O$. Thus the amount of angulation of profiled body 16 may be less than depicted in FIG. 1 if less force F is desired.

Figure 5:
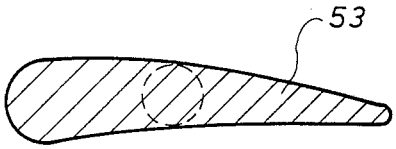
Figure 6:
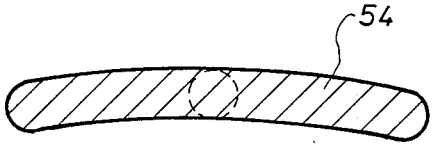
Figure 7:
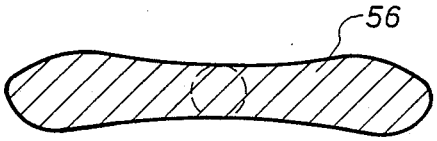

In FIG. 1 the profiled body 16 is depicted as having a generally elliptical shape. However, other possible cross-sectional shapes may also be used. Several of these possible shapes for profiled body 16 are depicted at 53, 54 and 56 in FIGS. 5, 6 and 7, respectively. In FIG. 5 the profiled body 53 is convex on the side turned to the screened surface ink roller 1 and concave on the side of the ink return flow. One of the rounded ends of profile body 53 is larger than the other so that body 53 has a somewhat wing-like cross-sectional configuration. The profiled body 54 shown in FIG. 6 is also convex on one side and concave on the other. However, each of its ends are the same so it is somewhat arcuate in cross-section. In the profiled body 56 shown in FIG. 7 there are shown two concave surfaces and rounded ends to provide a somewhat dogbone cross-sectional shape.

Figure 4:
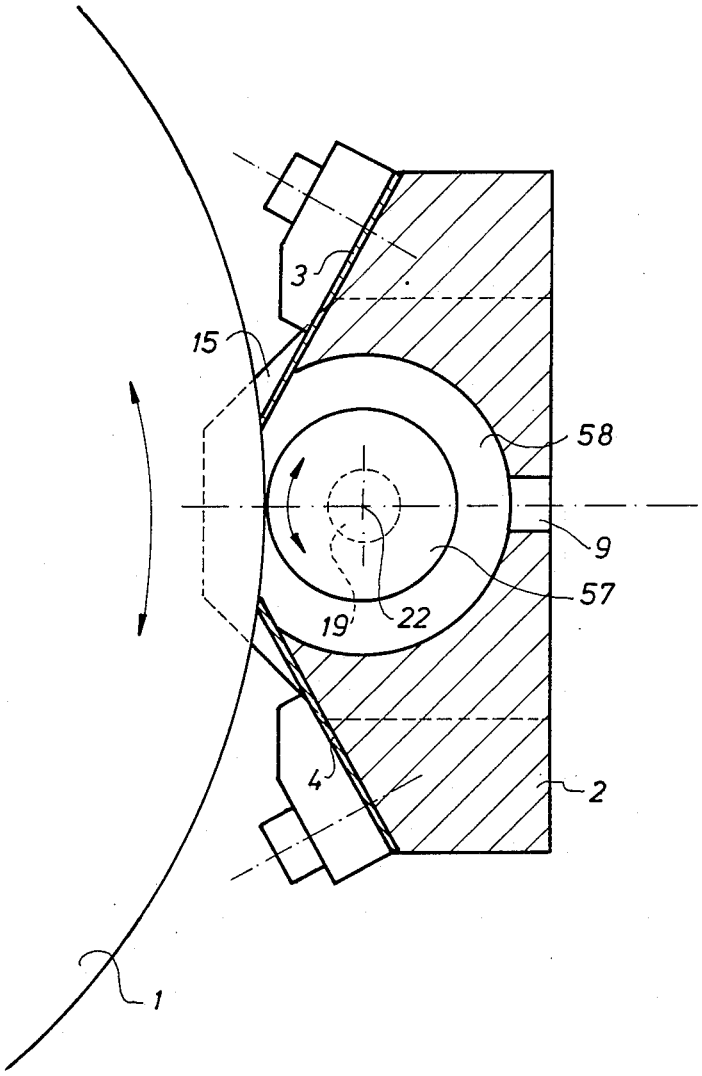
FIG. 4 is a side elevation view, partly in cross-section of a second preferred embodiment of an inking bar in accordance with the present invention; an FIGS. 5, 6, and 7 are cross-sectional view of three shapes of profiled bodies useable in the inking bar of the first preferred embodiment.

In the second preferred embodiment which is depicted in FIG. 4, a cylindrical profiled body 57 is arranged within a circular ink distributing chamber 58. The profiled body 57 is rotatably supported in the chequer plates 23 and 28 and can be brought into contact with the screen type ink fountain roller 1. The profiled body 57 is driven by means of friction by the screen type ink fountain roller 1. It would also be possible to drive the profiled body 57 by auxiliary means. It is also possible to provide mans such a, for instance location of the profiled body 57 in eccentric bushings to modify the axle distance between profiled body 57 and the screen type ink fountain roller 1. Consequently, the circumferential speed, $V_2$, of the profiled body 57 is reduced and simultaneously the smallest gap width $S_O$ is increased so that the ink pressure applied to the screen type ink fountain roller 1 is decreased as the profiled body 57 of the second preferred embodiment is moved away from the screened surface ink fountain roller 1.

In each of the first and second preferred embodiments of the inking bar for a flush inking unit in accordance with the present invention, it will be understood that the surfaces of the profiled bodies 16, 53, 54, 56 and 57 are to be made as smooth as possible. This will further reduce any flow disturbances or turbulence in the ink as it flows over and around the profiled body in the ink distributing chamber.

While preferred embodiments of an inking bar for a flush inking unit of a rotary printing press in accordance with the present invention have ben set forth fully and completely hereinabove, it will be apparent to one of skill in the art that a number of changes in, for example the size of the screened surface ink fountain roller, its tYpe of drive means, the particular pattern and sizes of indentation, the type of ink supply means and the like could be made without departing from the true spirit and scope of the present invention which accordingly is to be limited only by the following claims.

What is claimed is:

1. An inking bar assembly for a flush inking unit of a rotary printing press, said inking bar assembly being positionable adjacent to, and cooperable with a rotatable ink fountain roller, said assembly comprising;

a rotatable screened ink fountain roller;

an inking bar positionable adjacent a peripheral surface of said ink fountain roller and extending along said peripheral surface of said ink fountain roller generally parallel to an axis of rotation of said ink fountain roller;

an ink distributing chamber in said inking bar, said ink distributing chamber having a length generally the same as said inking bar and being formed between spaced doctor blades which are secured to said inking bar and which contact said peripheral surface of said ink fountain roller;

a profiled body having a generally non-circular cross-sectional shape and being positioned within said ink distributing chamber to facilitate unrestricted flow of ink around said profile body to said ink fountain roller, said profiled body having an elongated axis which is generally parallel to said axis of rotation of said ink fountain roller;

axially extending support journals at first and second ends of said profiled body; and means engaging each of said axially extending support journals to support said profiled body in said ink distributing chamber for pivotal movement about said elongated axis of said profiled body to vary an amount of angulation between a peripheral surface of said profiled body and said periphery of said ink fountain roller.

2. The inking bar of claim 1 wherein said support journals are rotatably supported in first and second chequer plates which are attached to first and second ends of said inking bar.

3. The inking bar of claim 2 wherein said means engaging each of said axially extending support journals includes a threaded adjusting spindle that passes through a threaded holder which is secured to said inking bar, each said spindle having a first end that is pivotably secured in a lever which is carried by said support journal.

4. The inking bar of claim 1 wherein said profiled body is generally elliptical in cross-section.

5. The inking bar of claim 1 wherein said profiled body is generally wing shaped in cross-section.

6. The inking bar of claim 1 wherein said profiled body is generally arcuate in cross-section.

7. The inking bar of claim 1 wherein said profiled body is generally dogbone-like in cross-section.

* * * * *